US006939070B2

(12) United States Patent
Butz et al.

(10) Patent No.: US 6,939,070 B2
(45) Date of Patent: Sep. 6, 2005

(54) DEVICE FOR RECEIVING AND DISPENSING A COATABLE MATERIAL

(75) Inventors: Wolfgang Butz, Duesseldorf (DE); Peter Gonzalez-Koehn, Duesseldorf (DE); Axel Uwe Kochler, Juechen (DE); Peter Kuklik, Haan (DE); Rainer Dahm, Mettmann (DE); Karsten Wolf, Wunstorf (DE)

(73) Assignee: Henkel Kommandirgesellschaft auf Aktien, Duesseldorf (DE)

( * ) Notice: Subject to any disclaimer, the term of this patent is extended or adjusted under 35 U.S.C. 154(b) by 122 days.

(21) Appl. No.: 10/008,326

(22) Filed: Nov. 7, 2001

(65) Prior Publication Data

US 2002/0081137 A1 Jun. 27, 2002

(30) Foreign Application Priority Data

Nov. 7, 2000 (DE) ..... 100 54 984

(51) Int. Cl.[7] ..... A45D 40/20; B43K 5/06
(52) U.S. Cl. ..... 401/88; 401/75; 401/175
(58) Field of Search ..... 401/88, 175, 174, 401/75, 68, 172

(56) References Cited

U.S. PATENT DOCUMENTS

| | | | |
|---|---|---|---|
| 1,876,797 | A | 9/1932 | Treleven |
| 1,907,376 | A | 5/1933 | Weck |
| 1,969,027 | A | 8/1934 | Morrison |
| 2,079,744 | A | 5/1937 | Maguire |
| 2,421,246 | A | 5/1947 | David |
| 2,589,000 | A | 3/1952 | Vani |
| 2,625,302 | A | 1/1953 | Mahoney |
| 2,717,101 | A | 9/1955 | Van Handel |
| 2,720,966 | A | 10/1955 | Davis |
| 2,770,358 | A | 11/1956 | Keith |

(Continued)

FOREIGN PATENT DOCUMENTS

| | | |
|---|---|---|
| CA | 50425/74 | 12/1990 |
| DE | 1 811 466 | 8/1969 |
| DE | 7011820 | 2/1970 |
| DE | 2 035 732 | 1/1972 |
| DE | 21 39 123 | 1/1979 |
| DE | 195 01 213 A1 | 7/1996 |
| EP | 0 395 914 A1 | 11/1990 |
| EP | 0 405 329 B1 | 4/1993 |
| EP | 0 391 862 B1 | 8/1994 |
| EP | 0 506 300 B1 | 6/1996 |
| FR | 942379 | 2/1949 |
| FR | 1049134 | 12/1953 |
| FR | 2227311 | 4/1974 |
| FR | 2 556 941 | 6/1985 |
| GB | 890683 | 3/1962 |
| GB | 1012488 | 12/1965 |
| GB | 1 366 050 | 11/1973 |
| NL | 6616065 | 5/1967 |
| RU | 397536 | 9/1973 |
| WO | WO 90/15762 | 12/1990 |

*Primary Examiner*—David J. Walczak
(74) *Attorney, Agent, or Firm*—Stephen D. Harper; Glenn E. J. Murphy

(57) ABSTRACT

A device for receiving and dispensing a coatable material such as adhesive, glue, cosmetics and the like. A sleeve-shaped receiving element has a piston-shaped element carrying the coatable material that is displaceable in longitudinal direction by a screw spindle operated by an external rotary grip at the base of the receiving element. The underside of the piston-shaped element is formed to complement the inwardly protruding shape of the sleeve base or grip element, such that there is virtually no free space in which air can collect between the piston-shaped element and the sleeve base when the piston element is fully retracted in the receiving element. Thus the device avoids undesired bubble formation during the filling process, and undesired material break off during use can be largely excluded.

4 Claims, 1 Drawing Sheet

U.S. PATENT DOCUMENTS 3,217,869 A 11/1965 Katz et al.
3,358,699 A 12/1967 Bau
3,507,798 A 4/1970 Egan et al.
3,576,776 A 4/1971 Muszik et al.
3,589,821 A 6/1971 Barney et al.
3,612,705 A 10/1971 Duval
3,817,887 A 6/1974 Mestetsky
3,828,802 A 8/1974 Spanel
3,907,441 A * 9/1975 Idec et al. ..... 401/75
4,011,311 A 3/1977 Noomen et al.
4,019,654 A 4/1977 Van Manen
4,019,998 A 4/1977 Benson et al.
4,182,945 A 1/1980 McArdle et al.
4,298,036 A 11/1981 Horvath
4,382,825 A 5/1983 McCready
4,521,127 A * 6/1985 Tomburo et al. ..... 401/68
4,664,547 A * 5/1987 Rosenwinkel ..... 401/175
4,950,094 A * 8/1990 Yorks ..... 401/75
5,009,534 A 4/1991 Gueret
5,102,249 A 4/1992 Holloway et al.
5,150,978 A 9/1992 Stewart et al.
5,195,555 A 3/1993 Knapp
5,336,005 A 8/1994 Moeck et al.
5,371,131 A 12/1994 Gierenz et al.
5,567,071 A 10/1996 Lepsius et al.
5,842,802 A * 12/1998 Lang et al. ..... 401/68
6,129,471 A * 10/2000 Lang ..... 401/75
6,193,427 B1 2/2001 Benguigui
6,247,865 B1 6/2001 Russell et al.
D456,953 S 5/2002 Look
6,409,403 B1 6/2002 Woos
6,417,261 B1 7/2002 Maier et al.

* cited by examiner

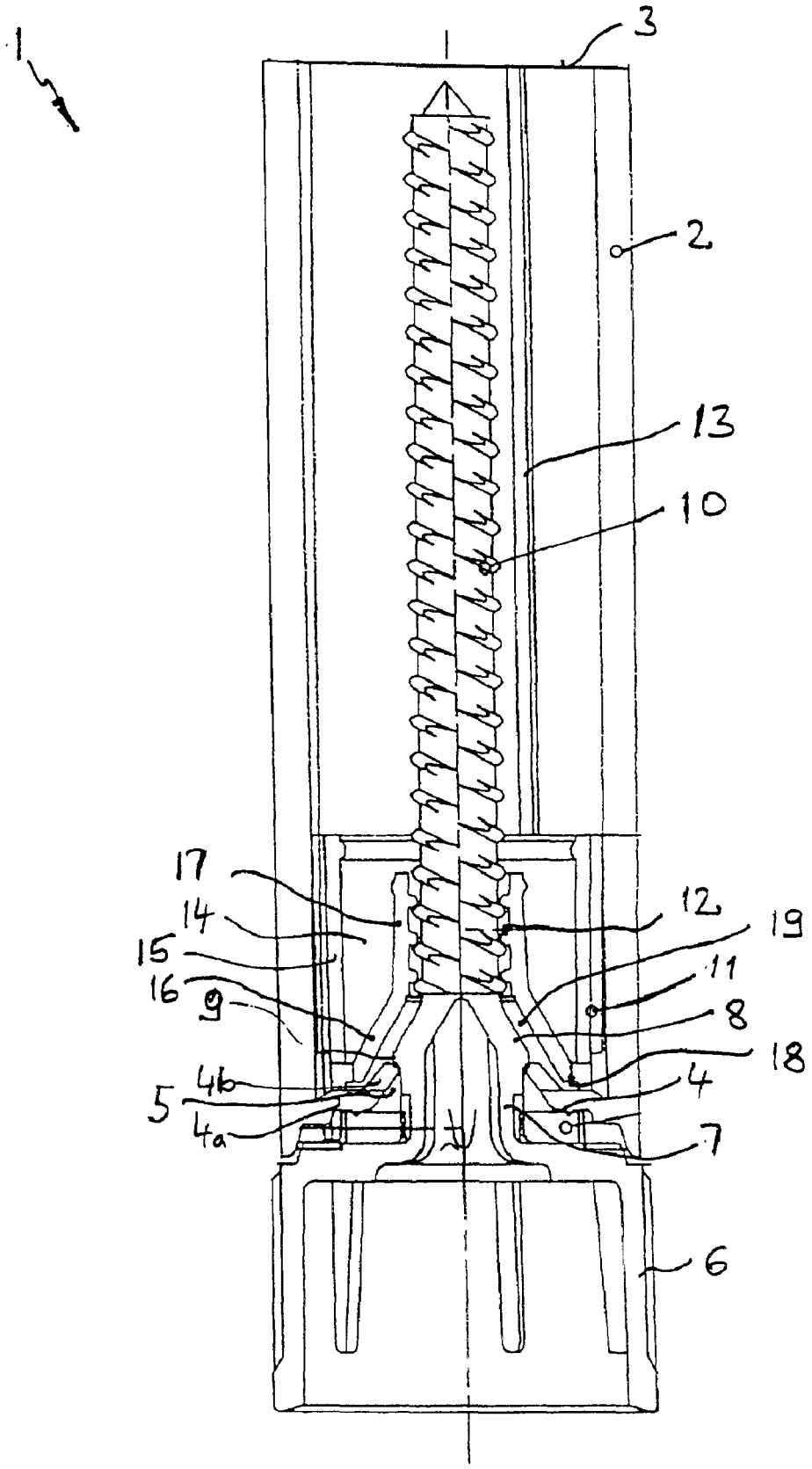
1
3
2
13
10
17
14
15
16
9
12
19
11
8
18
4
5
4b
4a
7
6

DEVICE FOR RECEIVING AND DISPENSING A COATABLE MATERIAL

CROSS REFERENCE TO RELATED APPLICATIONS

This application claims priority under 35 U.S.C. § 119 of German patent application DE 100 54 984.5, filed Nov. 7, 2000, the disclosure of which is hereby incorporated by reference.

BACKGROUND OF THE INVENTION

The invention relates to a device for receiving and dispensing a coatable material, such as adhesive, glue, cosmetics, and the like. The device generally comprises a sleeve-shaped receiving element in which a moving piston-shaped element carries the coatable material. The piston element has an internal thread and is arranged to be secure against rotation within the receiving element. The piston element is longitudinally displaceable within the receiving element by an externally operable rotary grip provided at the one end of the receiving element, the other end being the end from which the product is delivered. The rotary grip comprises a screw spindle rotatably mounted in a passage opening at the base of the receiving element, secured in axial direction, the spindle co-operating with the thread of the piston-shaped element to move the piston-shaped element back and forth within the receiving element and to allow the coatable product to be delivered from and retracted into the receiving element.

A device of that kind, from the applicant, has been known for a long time, for example in the form according to DE 21 39 123 B2. Such a known glue stick comprises a cylindrical sleeve, the open delivery end of which in the case of non-use is provided with a detachable closure cap for the purpose of avoiding drying out of the glue mass disposed in the sleeve. The glue mass within the sleeve is cast into a piston-shaped element and together with this is held in the sleeve to be secure against rotation, and arranged to be displaceable in longitudinal direction of the sleeve, wherein, for displacement, the piston-shaped element is provided in the centre with an internally threaded bore in which is engaged a screw spindle extending almost over the entire length of the sleeve and thus also through the glue mass and integrally merging at the end with a knurled, nut-like socket-shaped rotary grip with is rotatably mounted at the other end of the sleeve and protrudes outwardly therefrom, thus at the foot of the sleeve, and which enables manipulation of the device, in that with the sleeve firmly held the rotary grip is turned in one or other direction so that the piston-shaped element and the glue mass connected therewith move relative to the sleeve in one or other direction and make possible either delivery of glue or retraction of the glue mass into the sleeve.

This known device has proved itself particularly well for a long time, since it makes available an easily handled and, at the same time very rigid object. However, in practice it has proved that during the filling process of the coatable mass into the device a bubble formation frequently occurs in the mass, which can and frequently does lead to the result that in the later handling of the device a mass break off of the coatable material from the piston arises and thus so-called "no glue return" is promoted. In order to facilitate the filling process as such and in order to possibly be able to counteract this aforesaid effect, ventilating bores have previously been provided in the sleeve-shaped element, particularly in the state of art according to DE 21 39 123 B2, to make it possible for air to be able to exit downwardly out of the sleeve-shaped element during the filling process. These ventilating bores are unable, however, to prevent a mass break off; rather they even seem to promote this.

The object of the invention is accordingly to so improve a device according to the category that an undesired bubble formation during the filling process is avoided and thus undesired material break off can be largely excluded.

DESCRIPTION OF THE DRAWINGS

FIG. 1 is a section view of a device according to the invention.

DETAILED DESCRIPTION OF THE INVENTION

According to the invention this object is met with a device of the kind designated in the introduction in that the underneath outer profile of the piston-shaped element is formed to be complementary to the corresponding outer profile of the sleeve base and/or of the region, which projects inwardly into the sleeve-shaped element via the passage opening, of the socket-shaped rotary grip.

In reversal of previous solutions it is thus proposed in accordance with the invention to form the piston-shaped element at the underside to be quasi an exact fit with respect to the surrounding region of the sleeve base or of the region, which projects into the sleeve-shaped element, of the socket-shaped rotary grip, so that there is virtually no cavity below the piston-shaped element in the lower piston setting. Free space between the pistion shaped element and the sleeve base is confined to a region intermediate the complementary underside of the piston-shaped element and the region of the rotary grip when the piston-shaped element is adjacent the sleeve base. This has the consequence that no air can collect within the device below the piston-shaped element during the filling process, since virtually no corresponding free space is present between the piston-shaped element and the sleeve base. During the cooling-down process of the coatable glue mass filled into the device, no air can therefore be sucked into the mass from the region below the piston-shaped element, since practically no air is present in this region. A bubble formation can thereby be almost completely avoided, so that the undesired material break off of the coatable mass from the piston-shaped element during handling of the device no longer happens.

Since the sleeve base and the region surrounding the passage opening thereof usually have a roof-shaped or conical outer profile, it is with advantage provided that, for attainment of the complementary construction of the piston-shaped element, the piston-shaped element has a circularly annular outer wall which adjoins at the lower side a conical inner wall going over into a circularly annular inner wall region at the upper side, in other words, a sectioned cone joined with a cylinder.

A more general description of the form of the inner wall in this preferred embodiment is that of an inverted funnel shape, wherein the open end of the flared funnel section joins the outer wall on the underside of the piston-shaped element. Of course, it will be understood by those of skill in the art that the complementary shapes of the piston element underside and the inwardly projecting sleeve base or rotary grip can take any form such that virtually no corresponding free space is present between the underside of the piston-shaped element and the inwardly projecting elements at the base end of the receiving element when the piston element is fully retracted in the receiving element interior.

In a further advantageous embodiment, at least one ventilating opening is provided in the piston-shaped element that communicates underside of the piston-shaped element with the receiving element interior. Since a part of the coatable mass can flow slightly into the region of the ventilating opening during the filling process the anchoring of the coatable mass at the piston-shaped element is thereby even further improved; moreover, the filling process is simplified in per see known manner, since during the filling process air can exit downwardly through the ventilating opening.

The ventilating opening itself can be formed, as for example, a ventilating bore or also as a ventilating groove.

The invention is explained in more detail in the following by way of example with reference to the drawing, FIG. 1. This shows, in the single figure, a section through a device according to the invention.

A device according to the invention for receiving and dispensing a coatable material is denoted in the drawing generally by 1 and in the case of the embodiment is constructed as a glue stick, i.e. the coatable material is a glue mass. The device can obviously also be constructed as a lip balm stick and other uses are also equally possible.

The device 1 according to the invention comprises, first of all, a sleeve-shaped receiving element 2, the upper delivery end—which is open in the use state—of which is denoted by 3. A narrowed portion, which is not illustrated, with an encircling detent bead can be provided on the outer side at the sleeve-shaped receiving element 2 in the region of the delivery end 3; this serves the purpose of being able to fit in detented and sealed manner a closure cap, which is not illustrated.

The sleeve-shaped receiving element 2 has at the end opposite the open end 3 a sleeve base 4 with a central passage opening 5. In that case, the sleeve base 4 has a central base region 4*a* and a conically tapering opening region bounding the passage opening 5.

A socket-shaped rotary grip 6 is to be mounted at the receiving element 2 via the passage opening of the sleeve base 4. For that purpose the socket-shaped rotary grip 6 has the upper side a tubular protrusion 7 which goes over into a widened conical region 8, which is provided at its transition to the tubular protrusion 7 with an encircling detent bead 9 so dimensioned that on insertion of the socket-shaped rotary grip 6 into the sleeve-shaped receiving element 2 the rotary grip 6 comes into detenting contact with the detent bead 9 at the end of the conical region 4*b* and is thus secured in axial direction, but mounted to be rotatable. The conical region 8 of the rotary grip 6 tapes upwardly and goes over, preferably integrally, into a screw spindle 10, the length of which approximately corresponds to the height of the interior of the receiving element 2. For assembly of the device the rotary grip 6 together with the screw spindle 10 is introduced from below through the passage opening 5 into the receiving element 2 and clicked into place, whereby, as explained, the detent bead 9 bears in detenting manner in the region 4*b* of the sleeve base 4 and, in particular, in such a way that the rotary grip 6 can be turned relative to the sleeve-shaped receiving element 2 and is at the same time secured in axial direction at the receiving element 2 with a small play.

When the rotary grip 6 is mounted at the receiving element 2, a piston-shaped element 11, which is furnished with an internal thread 12, is introduced into the sleeve-shaped receiving element 2 from the free end 3 and screwed onto the screw spindle 10, wherein the piston-shaped element 11 has at the outer side a projection with engages in a groove 13 extending over the height of the receiving element 2, whereby security against rotation of the piston-shaped element 11 relative to the receiving element 2 is achieved. By turning the screw spindle 10 the piston-shaped element 11 is thereby displaced in longitudinal direction relative to the receiving element 2 in one or the other direction.

The piston-shaped element 11 has at the inner side a receiving region 14 which carries the coatable mass (not illustrated), for example glue.

The design of the outer profile of the piston-shaped element 11 is now of significance. The underneath outer profile of the piston-shaped element 11 is, in particular, formed to be complementary to the corresponding outer profile of the sleeve base 4 and of the conical region 8, which protrudes through the 3 passage opening 5 inwardly into the sleeve-shape element 2, of the socket-shaped rotary grip 6. For that purpose the piston-shaped element 11 has, in the embodiment, first of all a circularly annular outer wall 15, to which there adjoins at the underside a conical inner wall 16 which goes over into a circularly annular inner wall region 17 at the upper side, the region being furnished at the inner side with the internal thread 12 for the screw spindle 10.

By virtue of this shape of the piston-shaped element 11 virtually no free space, in which air could collect, exists in the lowest position, i.e. in the furthermost screwed-in position, of the piston-shaped element 11—which is illustrated—between the underneath outer profile of the piston-shaped element 11 and the adjoining regions of the sleeve-shaped receiving element 2 (conical region 4*b*) and the conical region 8 of the socket-shaped rotary grip 6.

At least one ventilating opening 18 communicating the underside of the piston-shaped element with the interior of the sleeve-shaped receiving element, which is preferably constructed as a ventilating bore or a ventilating groove, is preferably provided in the lowermost region of the piston-shaped element 11.

After assembly of the device 1 in the afore-described manner the coatable mass is filled into the device 1 itself. The mass in that case initially flows into the piston-shaped element 11, wherein air, which is disposed in the piston-shaped element 11, can exit outwardly through the ventilating opening 18. A part of the coatable mass in that case passes into the region of the ventilating opening 18 and can additionally anchor there at the piston-shaped element 11.

The invention is obviously not restricted to the illustrated embodiment. Further embodiments are possible without departing from the basic concept. Thus, in particular, the shape of the sleeve base 4 with passage opening 5 can be formed in a different manner, for example the concical region 4*b* of the sleeve base 4 can extend into the rearward region of the spindle 10, in the case of such a form, the underneath outer profile of the piston-shaped element 11 is then selected to be complementary to the shape in the conical region 4*b* of the sleeve base 4.

The invention is obviously not restricted to the illustrated embodiment. Further embodiments are possible without departing from the basic concept. Thus, in particular, the shape of the sleeve base 4 with passage opening 5 can be formed in a different manner, for example the conical region 4*b* of the sleeve base 4 can extend into the rearward region of the spindle 12; in the case of such a form, the underneath outer profile of the piston-shaped element 11 is then selected to be complementary to the shape in the conical region 4*b* of the sleeve base 6.

What is claimed is:

1. A device for receiving and dispensing a coatable material, comprising a sleeve-shaped receiving element having an interior, a delivery end, and a sleeve base generally opposite the delivery end, in which receiving element interior is arranged a piston-shaped element having an internal thread, said piston-shaped element being adapted to carry the coatable material on a side facing the delivery end of the receiving element, and having an underside facing the sleeve base, the piston-shaped element being arranged to be secure against rotation and to be displaceable longitudinally in either direction within the receiving element from the sleeve base toward the delivery end, the piston-shaped element being displaceable in the receiving element by an externally operable rotary grip provided at the sleeve base, wherein the rotary grip comprises a screw spindle that is rotatably mounted and secured in axial direction in a passage opening of the sleeve base and that is cooperable with the internal thread of the piston-shaped element, wherein a region of the rotary grip projects inwardly through the passage opening into the receiving element interior and is formed complementary to the underside of the piston-shaped element, the region of the rotary grip being conical or funnel shaped between the screw spindle and a detent bead of the rotary grip, which bead bears in a detenting manner with the sleeve base, whereby free space between the piston shaped element and the sleeve base is confined to a region intermediate the complementary underside of the piston-shaped element and the region of the rotary grip when the piston-shaped element is adjacent the sleeve base.

2. The device of claim 5, wherein the piston-shaped element comprises a cylindrical outer wall and an inner wall that forms a conical or funnel shape on the underside of the piston-shaped element, complementary to the inwardly-projecting sleeve base or rotary grip.

3. The device of claim 2, wherein the piston-shaped element has at least one ventilating opening communicating the underside of the piston-shaped element with the interior of the sleeve-shaped receiving element.

4. The device of claim 2, wherein at least one ventilating opening comprises a ventilating bore or ventilating groove.

* * * * *

UNITED STATES PATENT AND TRADEMARK OFFICE

CERTIFICATE OF CORRECTION

PATENT NO. : 6,939,070 B2
DATED : September 6, 2005
INVENTOR(S) : Butz et al.

It is certified that error appears in the above-identified patent and that said Letters Patent is hereby corrected as shown below:

Title page,
Item [73], Assignee, delete "Kommandirgesellschaft" and insert -- Kommanditgesellschaft --.

Column 4,
Delete lines 55 through 64.

Column 6,
Line 8, delete "claim 5" and insert -- claim 1 --.
Line 17, delete "claim 2" and insert -- claim 3 --.

Signed and Sealed this

Twenty-ninth Day of November, 2005

JON W. DUDAS
*Director of the United States Patent and Trademark Office*